US006145577A

United States Patent [19]

Hunter et al.

[11] Patent Number: 6,145,577

[45] Date of Patent: Nov. 14, 2000

[54] LINEAR MOLD HANDLING SYSTEM

[75] Inventors: William A. Hunter, Naples, Fla.; William G. Hunter, North Barrington, Ill.

[73] Assignee: Hunter Automated Machinery Corporation, Schaumburg, Ill.

[21] Appl. No.: 09/168,628

[22] Filed: Oct. 8, 1998

Related U.S. Application Data

[63] Continuation-in-part of application No. 08/783,647, Jan. 15, 1997, Pat. No. 5,901,774.

[51] Int. Cl.[7] ..... B22D 33/02; B22D 47/02

[52] U.S. Cl. ..... 164/323; 164/167; 164/324; 164/339; 164/412

[58] Field of Search ..... 164/323, 324, 164/322, 167, 339, 412; 198/465.1

[56] References Cited

U.S. PATENT DOCUMENTS

| | | | |
|---|---|---|---|
| 671,137 | 4/1901 | Johnston . | |
| 783,200 | 2/1905 | Henderson . | |
| 2,956,319 | 10/1960 | Deakins et al. | 164/324 |
| 3,029,482 | 4/1962 | Burnett . | |
| 3,068,537 | 12/1962 | Fellows | 164/324 X |
| 3,083,421 | 4/1963 | Taccone | 164/324 X |
| 3,123,871 | 3/1964 | Taccone | 164/323 X |
| 3,576,246 | 4/1971 | Hulet et al. | 198/19 |
| 3,605,869 | 9/1971 | Chapman et al. | 164/324 |
| 3,612,159 | 10/1971 | Galinsky | 164/324 |
| 3,682,236 | 8/1972 | Becke | 164/324 |
| 3,743,004 | 7/1973 | Becke | 164/18 |
| 3,821,978 | 7/1974 | Kauffman | 164/323 X |
| 3,955,613 | 5/1976 | Lund | 164/130 |
| 3,989,094 | 11/1976 | Gorenflo et al. | 164/324 |
| 4,040,525 | 8/1977 | Tokunaga et al. | 214/6 P |
| 4,105,060 | 8/1978 | Hauke | 164/130 |
| 4,224,979 | 9/1980 | Rosin et al. | 164/130 |
| 4,299,269 | 11/1981 | Friesen et al. | 164/324 |
| 4,422,495 | 12/1983 | Van Nette, III | 164/324 |
| 4,438,801 | 3/1984 | Buhler | 164/130 |
| 4,585,049 | 4/1986 | Sitta et al. | 164/324 |
| 4,589,467 | 5/1986 | Hunter | 164/326 |
| 4,747,444 | 5/1988 | Wasem et al. | 164/457 |
| 4,995,769 | 2/1991 | Berger et al. | 414/403 |
| 5,022,512 | 6/1991 | Hunter | 198/718 |
| 5,062,465 | 11/1991 | Mortensen | 164/4.1 |
| 5,063,987 | 11/1991 | Weimann | 164/324 |

FOREIGN PATENT DOCUMENTS

| | | | |
|---|---|---|---|
| 1236140 | 3/1967 | Germany | 164/324 |
| 3121268 | 12/1982 | Germany | 164/324 |
| 59-24570 | 2/1984 | Japan | 164/324 |
| 1731430 | 5/1992 | Russian Federation | 164/324 |
| 737113 | 5/1980 | U.S.S.R. | 164/324 |
| 869963 | 10/1981 | U.S.S.R. | 164/323 |
| 632104 | 11/1949 | United Kingdom | 164/324 |

*Primary Examiner*—J Reed Batten, Jr.
*Attorney, Agent, or Firm*—Leydig, Voit & Mayer, Ltd.

[57] ABSTRACT

A simplified mold handling system has a linear flowpath with adjustable throughput, variable cooling cycle capability, and minimized equipment and cost. The system has a mold handling conveyor with upper and lower levels on which pouring and cooling of the molds occur. The upper level of the conveyor receives sand molds and conveys the empty molds to a pouring station wherein molten material is deposited therein to form castings. After the castings have been poured, the molds are transferred to the lower level of the pouring conveyor for cooling purposes, and then back to the upper level. The sand molds are then either pushed to another row of the pallet, or are pushed down a ramp to a vibrating conveyor for removal of the sand. Such features allow adjustability in the dwell time required for cooling of the given metal. By using a single conveyor line, with a single set of elevators, and multiple pusher arms powered by a single cylinder, the cost of the system is minimized, the system is simplified, and cooling dwell time is still adjustable.

16 Claims, 7 Drawing Sheets

LINEAR MOLD HANDLING SYSTEM

CROSS-REFERENCE TO RELATED APPLICATION

This is a continuation-in-part application of U.S. patent application Ser. No. 08/783,647 filed on Jan. 15, 1997, now U.S. Pat. No. 5,901,774, entitled LINEAR MOLD HANDLING SYSTEM WITH DOUBLE-DECK POURING AND COOLING LINES.

FIELD OF THE INVENTION

The present invention generally relates to mold handling systems, and more particularly relates to sand mold handling systems.

BACKGROUND OF THE INVENTION

Molded metal castings are commonly manufactured at foundries through a matchplate molding technique which employs green sand molds comprised of prepared sand and additives which are compressed around cope and drag patterns mounted on opposite sides of a matchplate. The sand mold is thus formed in upper and lower matching portions, an upper cope mold, and a lower drag mold. The cope mold is formed in a separate cope flask which is filled with prepared sand and compacted onto the matchplate. The matchplate is then removed leaving an indentation in the cope mold of the desired shape for the upper portion of the casting. Simultaneously, the drag mold is formed in a separate drag flask. Usually the matchplate is in the form of a planar member with the pattern for the cope mold on one side and the pattern for the drag mold on the other. After the cope and drag molds have been formed, they are placed together to form a unitary mold having an interior cavity of the desired shape. The cavity can then be filled with molten metal through an inlet or "sprue" provided in the cope mold to create the desired casting. Such a system is disclosed in Hunter U.S. Pat. No. 5,022,212.

As with many volume sensitive production operations, manufacturers are required to automate the manufacturing process in order to remain competitive. Foundries engaging in the casting of metal objects through the use of green sand molds are not immune to this reality. It is common in today's marketplace, for the machine which produces the sand molds to be connected to a machine which fills the sand mold with molten metal, which in turn is connected to a machine for cooling the molten metal into a solid casting, which in turn is connected to a machine for removing the sand mold and revealing the casting for harvest. Such a system is disclosed in Hunter U.S. Pat. No. 4,589,467.

In the aforementioned '467 patent, the sand molds are manufactured and communicated along a linear conveyor to a circular, rotating, or "carousel" conveyor. Molten metal is introduced into the molds at one location on the carousel and the molten metal is then allowed to cool within the sand mold as the carousel rotates. The carousel is provided with both an outer diameter track and an inner diameter track which provide for additional cooling of the metal, and which increase the throughput of the machine.

While such a carousel system has enjoyed, and continues to enjoy, considerable commercial success, it is not without its drawbacks. In particular, if a manufacturer wishes to increase the throughput of a carousel-type molding machine, a carousel of a different diameter will necessarily have to be employed, at considerable additional expense. In addition, every time a new carousel is needed, a substantial downtime period is encountered wherein the machine is not producing castings, and which requires considerable labor to put into effect.

Similarly, if the cooling times of the metal being processed through machine are variable, the length of the cooling cycle will accordingly be affected. With a carousel-type conveyor, the cooling cycle time can be increased either by slowing the carousel, or by adding a carousel of a greater diameter. Conversely, if the cooling time is to be lessened, the rotational speed of the carousel can be increased, or a carousel having a smaller diameter can be added. However, both options are less than desirable. If the carousel is slowed, the throughput of the machine is proportionally diminished, and if a new carousel is added, additional expense is incurred due to increased downtime and additional equipment overhead.

Co-pending U.S. patent application Ser. No. 08/783,647 therefore discloses a linear mold handling system wherein separate double-deck pouring and cooling conveyors are provided. Sand molds are transferred to the pouring conveyor and indexed to a station in which molten metal is deposited into the sand molds. The molten metal filled sand molds are then transferred to a lower level of the pouring conveyor and then back to the upper level of the pouring conveyor before being transferred to a separate cooling conveyor provided laterally adjacent to the pouring conveyor. The embodiment disclosed in the aforementioned parent application provides a cooling conveyor which is three rows wide and includes a plurality of trays adapted to receive up to three molds disposed on the conveyor. The partially cooled sand molds are transferred from the pouring conveyor to the cooling conveyor and into one of the trays disposed thereon. Each tray is adapted to receive up to three sand molds. Once a tray is filled, it is indexed forward until reaching an end of the upper level of the cooling conveyor at which time the elevator lowers the trays to a lower level and then back to an upper level of the cooling conveyor before being pushed into a dump chute and a shake-out vibrating conveyor.

However, depending on the particular metal being poured differing dwell times will be required for adequate cooling of the poured metal. In certain instances, it may not be necessary to provide four complete rows for cooling of the metal. In addition, since such an embodiment employs completely separate pouring and cooling conveyors, dual sets of conveyors, elevators, controls, and the like are required which necessarily result in added expense, maintenance and complexity.

SUMMARY OF THE INVENTION

It is therefore an aim of the preferred embodiment of the present invention to provide a linear sand mold handling system wherein a single line of upper and lower conveyors is used on which the pouring and cooling takes place.

It is another aim of the preferred embodiment of the present invention to provide a linear sand mold handling system with an ability to be tailored to the specific dwell time requirements of the metal being poured.

It is another aim of the present invention to provide a simplified sand mold handling system with reduced equipment requirements and thus reduced cost for both initial start-up and for maintenance over time.

It is an objective of the present invention to provide a linear sand mold handling system with improved volumetric capacity or throughput capability.

It is another objective of the present invention to provide a linear sand mold handling system with more uniform cooling in order to provide more physically reliable and predictable castings.

It is a feature of the preferred embodiment of the present invention to provide a linear mold handling system for use in a sand mold casting machine having a mechanism for producing a plurality of sand molds, a mechanism for pouring molten metal into the sand molds to form castings, a mechanism for cooling the molten metal, and a mechanism for removing the sand from the cooled castings. The mold handling system in one embodiment comprises a two-tiered mold handling conveyor having an upper track and a lower track of a width sufficient to accommodate one row of sand molds, and a plurality of pouring pallets on the conveyor sized to receive one sand mold. The sand molds and pallets are conveyed on the upper track from the mechanism for producing sand molds to the pouring mechanism, the conveyor having a first elevator to move the molds from the upper track to the lower track, and a second elevator for moving the molds from the lower track to the upper track.

It is another feature of another preferred embodiment of the present invention to provide a linear mold handling system similar to that described above except that the two-tiered mold handling conveyor includes first and second rows and further including a plurality of pouring and cooling pallets on the conveyor adapted to receive first and second molds. The sand molds are poured during transportation through the first row, and are then pushed across the pallets to a second row for additional cooling time after being cycled through the conveyor upper and lower levels.

It is still another feature of another preferred embodiment of the present invention to provide a linear mold handling system similar to that described above except that the two-tiered conveyor includes first, second, and third rows, and the pouring and cooling pallets are adapted to receive first, second, and third molds. The molten metal is poured during transportation through the first row, with the molds then being pushed across the pallets to the second row, and then being pushed across the pallets to the third row for additional cooling time, after each cycle through the conveyor.

It is still another feature of the present invention to provide a single hydraulic cylinder to power multiple pusher arms for moving molds across the pallets from row to row.

These and other aims, objectives, and features of the invention will become more apparent from the following detailed description when taken in conjunction with the accompanying drawings.

Figure 1:
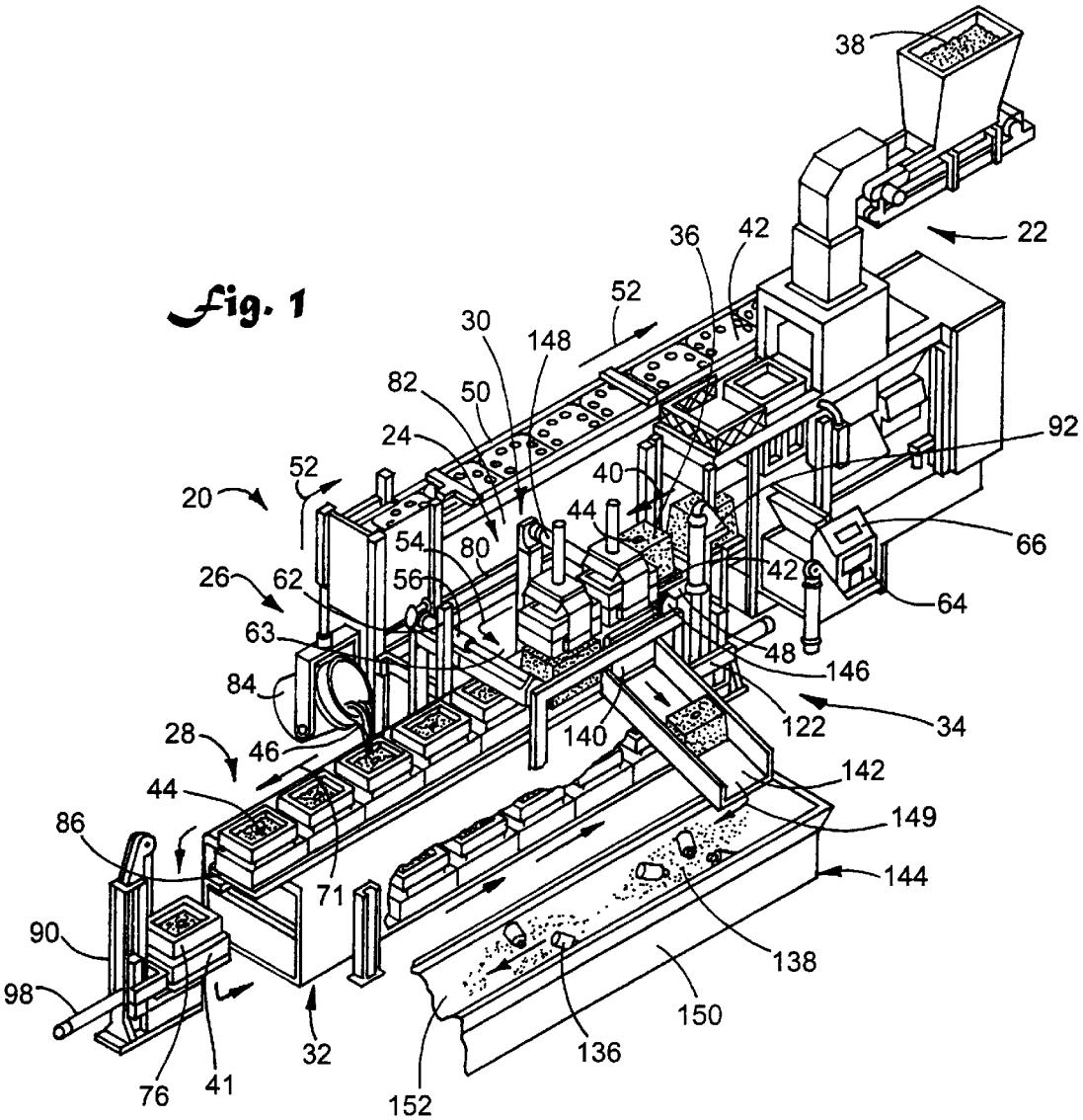
FIG. 1 is a perspective view of the first preferred embodiment of the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to FIG. 1, the present invention, generally depicted as sand mold handling system 20, is comprised of sand mold forming station 22, weight and jacket installation station 24, pouring station 26, mold handling conveyor 28, weight and jack removal station 30, and discharge station 34. As depicted by the directional arrows shown in FIG. 1, the motion of sand mold 36 from start to finish, defines a linear flow path, the importance of which will be discussed in further detail. It is important to note from FIG. 1 that a first embodiment of the present invention is depicted and that other embodiments are disclosed herein. Moreover, while the disclosed embodiments are related to co-pending application Ser. No. 08/783,647, the embodiments disclosed herein do not include separate pouring and cooling conveyors, but rather have a single conveyor of variable width across which pallets of variable width traverse, and on which the pouring and cooling operations occur.

Although the present invention is directed toward the mold handling system, for completeness and clarity of function the machine depicted in FIG. 1 also shows a sand mold forming station 22 which produces sand molds 36. It is to be understood that sand mold forming station 22 is of a conventional matchplate forming design in which sand 38 is compressed within a flask about a matchplate. The sand mold is typically formed from two portions (not shown), an upper cope mold, and a lower drag mold. One cope mold and one drag mold are combined to form a unitary sand mold 36 comprised of compressed sand and having an internal cavity of the desired shape for the casting. Those of ordinary skill in the art will understand that cores can be inserted into the cavity so as to form internal apertures within the resulting castings. Such cores are also typically formed from compressed sand. Such a process is described in the aforementioned Hunter U.S. Pat. No. 5,022,512, the disclosure of which is expressly incorporated by reference herein.

As shown in FIG. 1, sand molds 36 exit from sand mold forming station 22 in the direction depicted by arrow 40. Sand molds 36 exit station 22 on bottom boards 42, and are provided with inlets, or sprues, 44 for the entrance of molten metal 46. Shuttle conveyor 48 is provided to transport sand molds 36 from sand mold forming station 22 to weight and jacket installation station 24. Bottom board return conveyor 50 is provided to transport bottom boards 42 back to sand mold forming station 22 in the direction depicted by arrows 52 after molds 36 are pushed from bottom boards 42 on to pouring pallets 37 at the weight and jacket installation station 24. In the preferred embodiment pouring pallet 37 is manufactured from cast iron.

Figure 2:
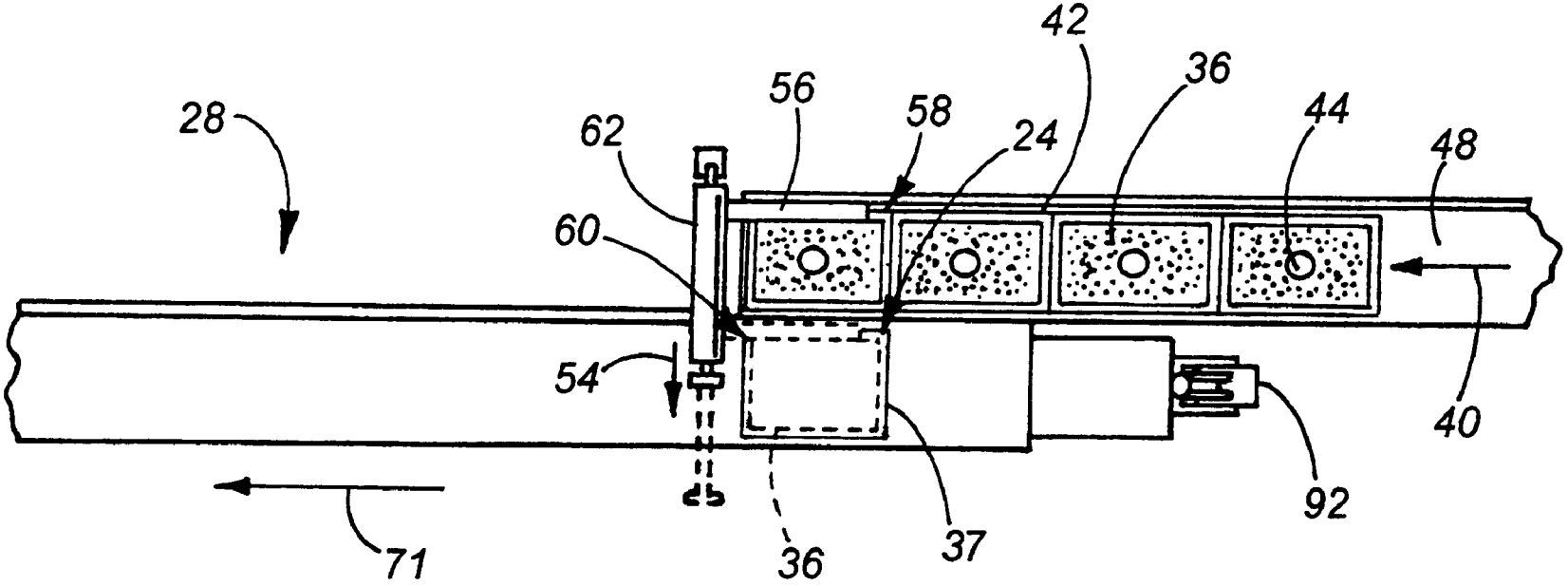
FIG. 2 is a schematic view of the transfer of sand molds from the shuttle conveyor to the first row of the mold handling conveyor.

With specific reference to the first preferred embodiment of the present invention, it can be seen that upon reaching the end of shuttle conveyor 48, sand molds 36 are moved from shuttle conveyor 48 to mold handling conveyor 28 having a width sufficient to accommodate a single row of sand molds 36. More specifically, conveyor 28 has a width sufficient to accommodate pouring pallets 37 adapted to hold a single mold 36. Upon being transferred to conveyor 28 and pallets 37, sand mold 36 is at weight and jacket installation station 24. This motion is in the direction depicted by arrow 54. Weight and jacket installation station 24 is located along upper track 86 (FIG. 3) of conveyor 28. As shown in FIG. 2, this motion is accomplished through the use of pusher arm 56 which is indexable between position 58 and position 60 shown in shadow. Pusher arm 56 is powered by pneumatic or hydraulic ram 62 which is of a simple and conventional design. Pusher arm 56 includes a substantially rectangular flap which engages sand molds 36.

Figure 3:
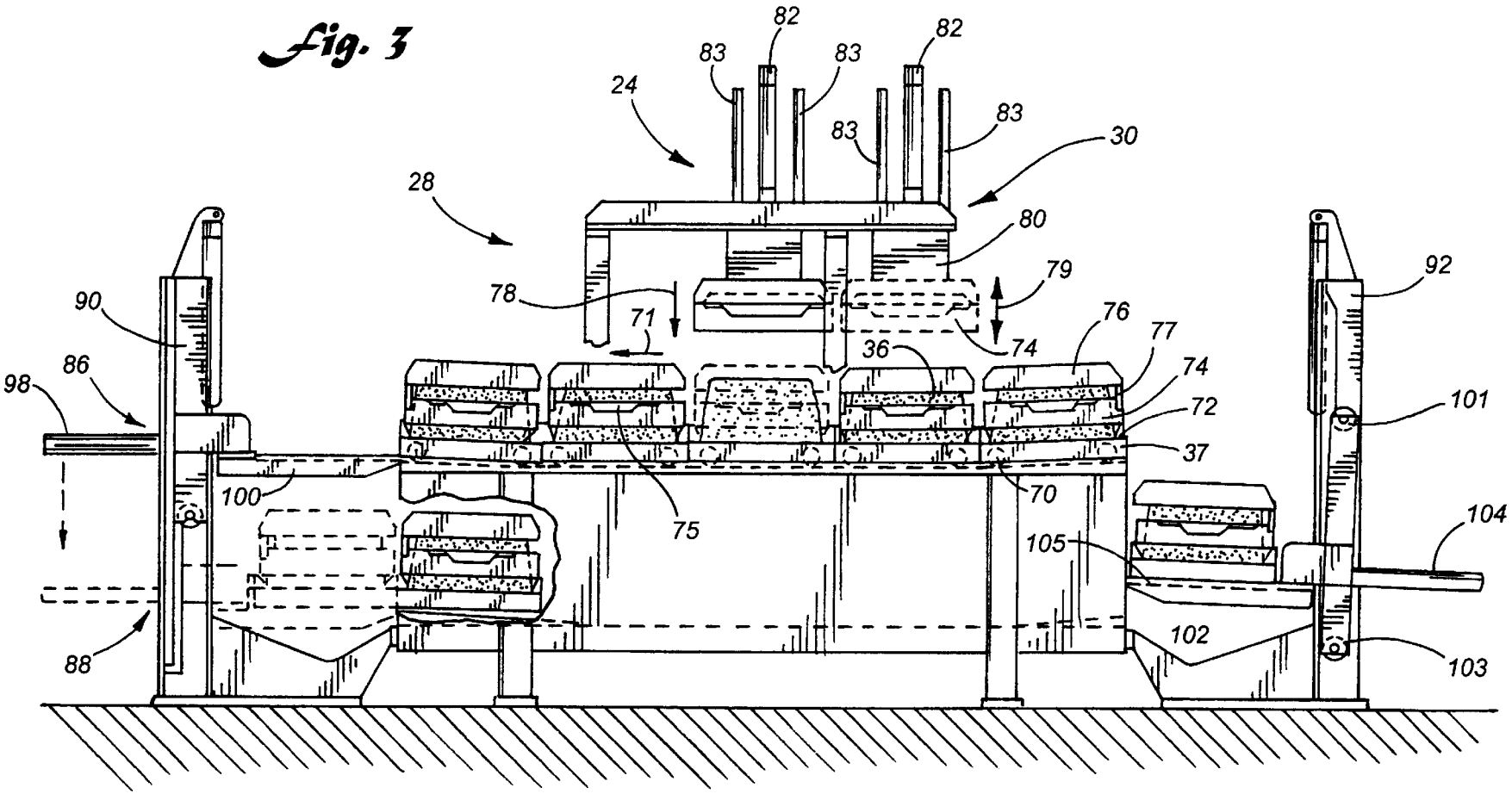
FIG. 3 is a side view of the mold handling conveyor.
Figure 4:
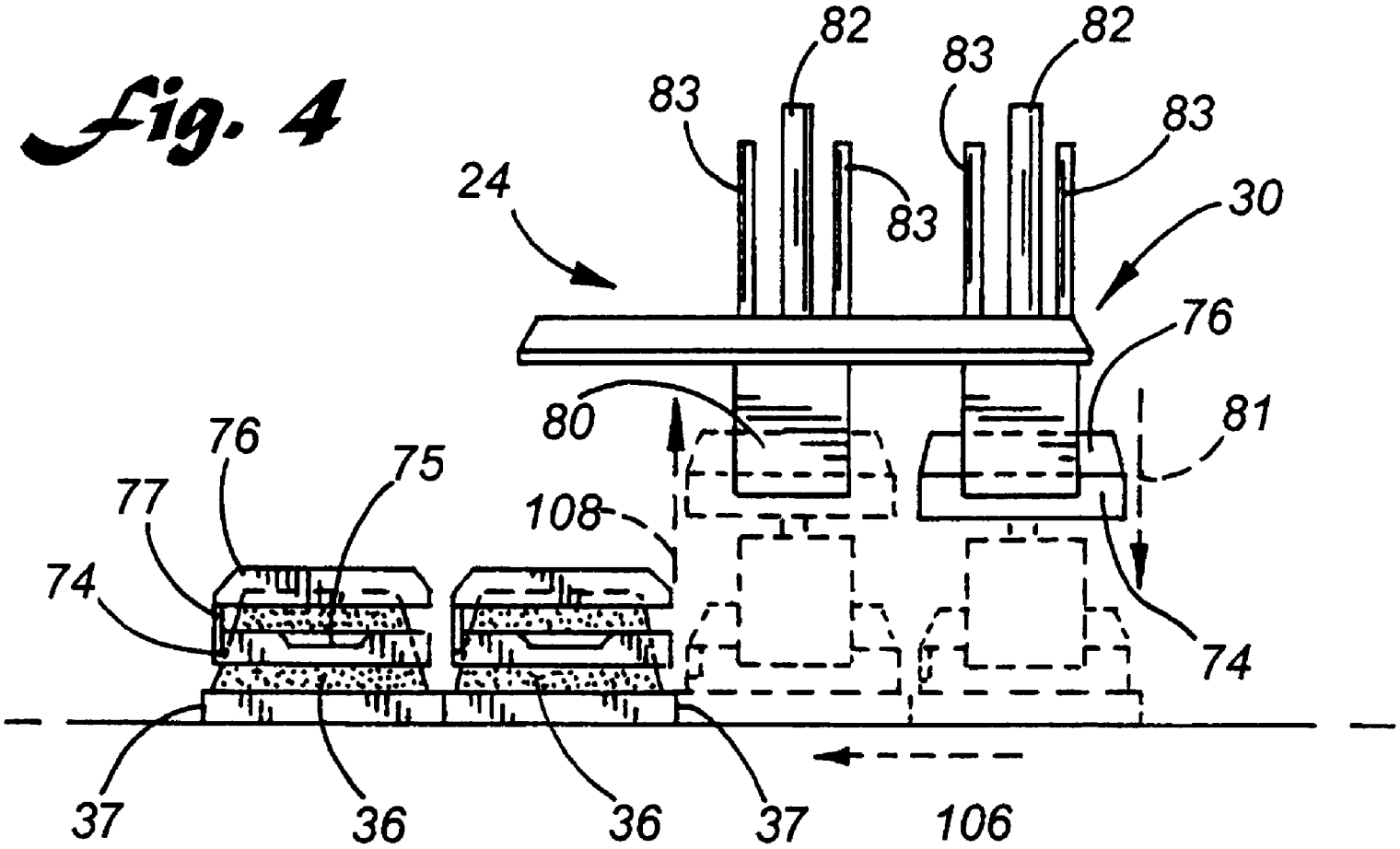
FIG. 4 is a schematic view depicting the movement of a weight and jacket set after being removed, placed back on to the mold handling conveyor, indexed to the weight and jacket installation station and raised for installation onto a new sand mold.

Sand molds 36 are moved from bottom boards 42 to pouring pallets 37 at weight and jacket installation station 24. As best shown in FIG. 3, pouring pallets 37 are provided with casters 70 to provide locomotion to sand molds 36, and raised corners to align with jacket 74 as will be described with further detail herein. After being placed on pouring pallet 37, jacket 74 is installed around the middle of sand mold 36, and weight 76 is placed on top of sand mold 36 as shown in FIG. 4. In the preferred embodiment, weights 76 include guide pins 77 to align weights 76 with jackets 74. The sides of sand mold 36 are slanted to facilitate this installation.

The installation of jacket 74 and weight 76 are best depicted in FIG. 3 wherein the motion of jacket 74 and weight 76 as they are being placed onto sand molds 36 is depicted by arrow 78. Gripper arms 80 are provided to grasp and release jacket 74 and weight 76 through frictional, magnetic, or other methods. Gripper arms 80 are adapted to move up and down along main shaft 82, and auxiliary rods 83. In the preferred embodiment, gripper arms 80 are provided with hooks which engage ledges 75 provided on jackets 74.

From weight and jacket installation station 24, sand molds 36, equipped with jacket 74 and weight 76, proceed to pouring station 26 along upper track 86 of conveyor 28 in the direction of arrow 71. As depicted in FIG. 1, it is at pouring station 26, that molten metal 46 is introduced into sand molds 36 through sprue 44. In the embodiment depicted in FIG. 1, molten metal 46 is manually introduced into sand molds 36 from supply 84, although automated mechanisms for such action are certainly possible. In the preferred embodiment, vat 84 is mounted on an overhead track (not shown) which allows vat 84 to be manually transported from a source of molten metal to pouring station 26. It is to be understood that although pouring station 26 is shown in a specific location, pouring station 26 may be moved to a number of positions along mold handling conveyor 28.

Referring now to FIG. 3, conveyor 28 is shown in detail. It is conveyor 28 which transports sand molds 36 and pallets 37 from weight and jacket installation station 24 to pouring station 26, and ultimately to weight and jacket removal station 30 in a continuous loop. Conveyor 28 is comprised of upper track 86 and lower track 88 wherein communication between upper track 86 and lower track 88 is accomplished by elevator 90 and communication between lower track 88 and upper track 86 is accomplished through elevator 92. It is important to note that conveyor 28 is not a "conveyor" in the traditional sense in that it does not include any internal driving mechanism, but rather is comprised of rails along which pouring pallets 37 having casters 70 are pushed via hydraulic rams 98 and 104 provided on elevators 90 and 92, respectively.

As shown in FIG. 2, each pouring pallet 37 is in engagement with other pouring pallets 37 situated both fore and aft. Elevators 90 and 92 not only provide motion between upper track 86 and lower track 88, and vice versa, but also provide locomotion along upper track 86 and lower track 88 through the use of rams 98 and 104. As shown in FIG. 3, after elevator 90 moves sand mold 36 from upper track 86 to a position adjacent lower track 88 (shown in dashed lines), ram 98 pushes sand mold 36 from platform 100 to lower track 88. The force of this motion directs sand mold 36 onto lower track 88, and by engaging the other sand molds 36 on lower track 88, pushes the other sand molds 36, and ultimately pushes one sand mold 36 onto platform 102 of the second elevator 92. Elevator 92 then lifts sand mold 36 to upper track 86, and through the use of ram 104 pushes sand mold 36 onto upper track 86. Therefore, it can be seen that conveyor 28 is comprised of a multiple, yet discrete, number of positions and sand molds 36 are indexed serially from one position to the next. As best shown by elevator 92 shown in FIG. 3, the elevators of the present invention are adapted to tilt backward to allow sufficient clearance during each lift. Upper pivot 101 and lower pivot 103 cooperate to tilt platform 102 so that front lip 105 of platform 102 is raised to a height sufficient to clear upper track 86 and lower track 88. This arrangement substantially eliminates the possibility of pouring pallet 37 not being raised to a sufficient height and thereby engaging the end of each track and preventing movement of the baseplate from the pallet and to the upper and lower tracks.

It is to be understood that as molten metal 46 is introduced into sand molds 36 at pouring station 26, molten metal 46 immediately begins to cool. As sand molds 36 traverse conveyor 28, molten metal 46 continually cools to a semi-solid state. Therefore, depending on the particular metal being poured, upon reaching weight and jacket removal station 30, weights 76 and jackets 74 can be removed as depicted in FIG. 3 without molten metal 46 affecting the integrity of sand mold 36. The removed jacket 74 and weight 76 are then placed back on pouring pallet 37 and indexed to weight and jacket installation station 24 in the direction depicted by arrows 106 and shown in FIG. 4. As alluded to earlier, raised corners 72 of pouring pallets 37 are used to align jackets 74 on top of pouring pallets 37. At weight and jacket installation station 24, gripper arms 80 again grasp jacket 74 and weight 76 and lift them upward along shaft 82 as best shown in FIG. 4 by directional arrow 108. After jacket 74 and weight 76 have been lifted at weight and jacket installation station 24 to the position shown in FIG. 4, a newly formed sand mold 36 is pushed onto pouring pallet 37 by pusher arm 56 as discussed earlier and as depicted in FIG. 2.

As shown in FIG. 3, at weight and jacket removal station 30, gripper arms 80 move downward in the direction of arrow 79 to grip the weights and jackets and then upward to lift the weights and jackets off sand mold 36. It is at this point in the sequence of operation that the different embodiments of the present invention are set apart. As stated earlier, depending on the particular metal being poured, different cooling or dwell times will be required before the metal actually hardens to allow the sand to be removed from the casting. With certain metals and mold shapes, a conveyor 28 of a single row width such as that shown in FIG. 1 will be sufficient to enable the casting to be fully hardened by the time it navigates the upper track and lower track of conveyor 28. With other metals and shapes, however, additional cooling time will be required, and the second and third embodiments of the present invention, as well as the embodiment shown in the parent application are provided to satisfy the additional cooling time requirements. As opposed to the embodiment disclosed in the parent application which uses completely separate pouring and cooling lines, and associated hardware, the present invention provides mechanisms for adjusting cooling time while using and maintaining a single line and thus one set of hardware including elevators.

Figure 5:
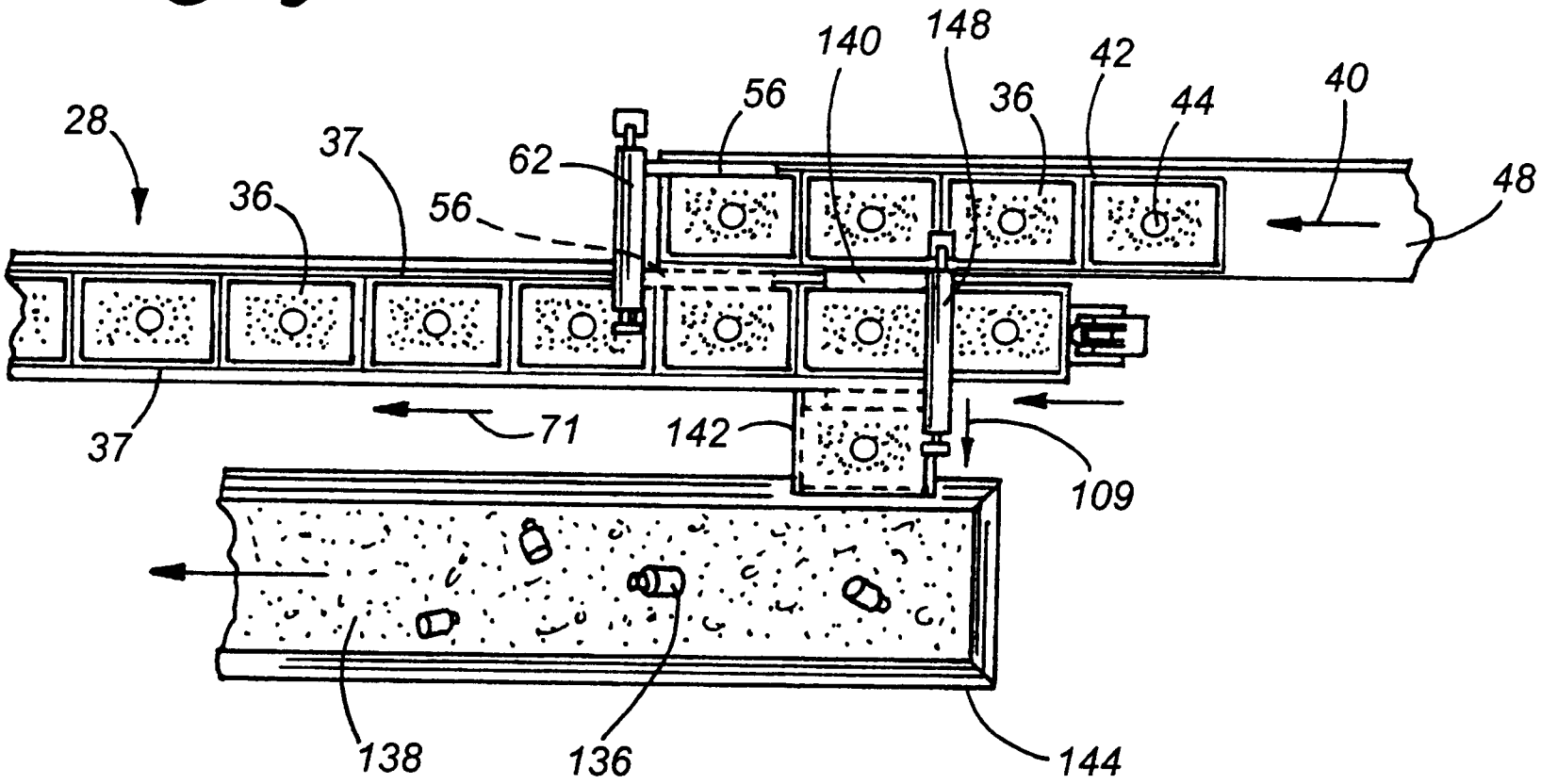
FIG. 5 is a schematic plan view showing removal of a cooled sand mold from the mold handling conveyor and onto the shake-out conveyor.

Before turning to the second and third embodiments, it can be seen in FIG. 5 that in the first embodiment of the present invention additional rows for cooling purposes are not provided and that upon reaching weight and jacket removal station 30, the metal is sufficiently cooled to allow the sand to be removed. To accomplish this, it can be seen in FIGS. 1 and 5 that a dump chute 142 is provided leading to shake-out conveyor 144.

In order to remove sand molds 36 from conveyor 28, a second hydraulically actuated pusher arm 140 is provided as best shown in FIG. 5. Pusher arm 140 is adapted for hydraulic movement by a ram 148 along beam 146 as shown in FIG. 1. Upon reaching dump chute 142, sand molds 36 fall to shake-out conveyor 144 through the effects of gravity as depicted by arrow 149. The force of this downward movement causes sand molds 36 to contact shake-out conveyor 144, which in turn causes residue 138 to fall away from castings 136. Shake-out conveyor 144 is provided to facilitate removal of sand residue 138 for recycling thereof and for removing castings 136 for harvest.

Figure 6:
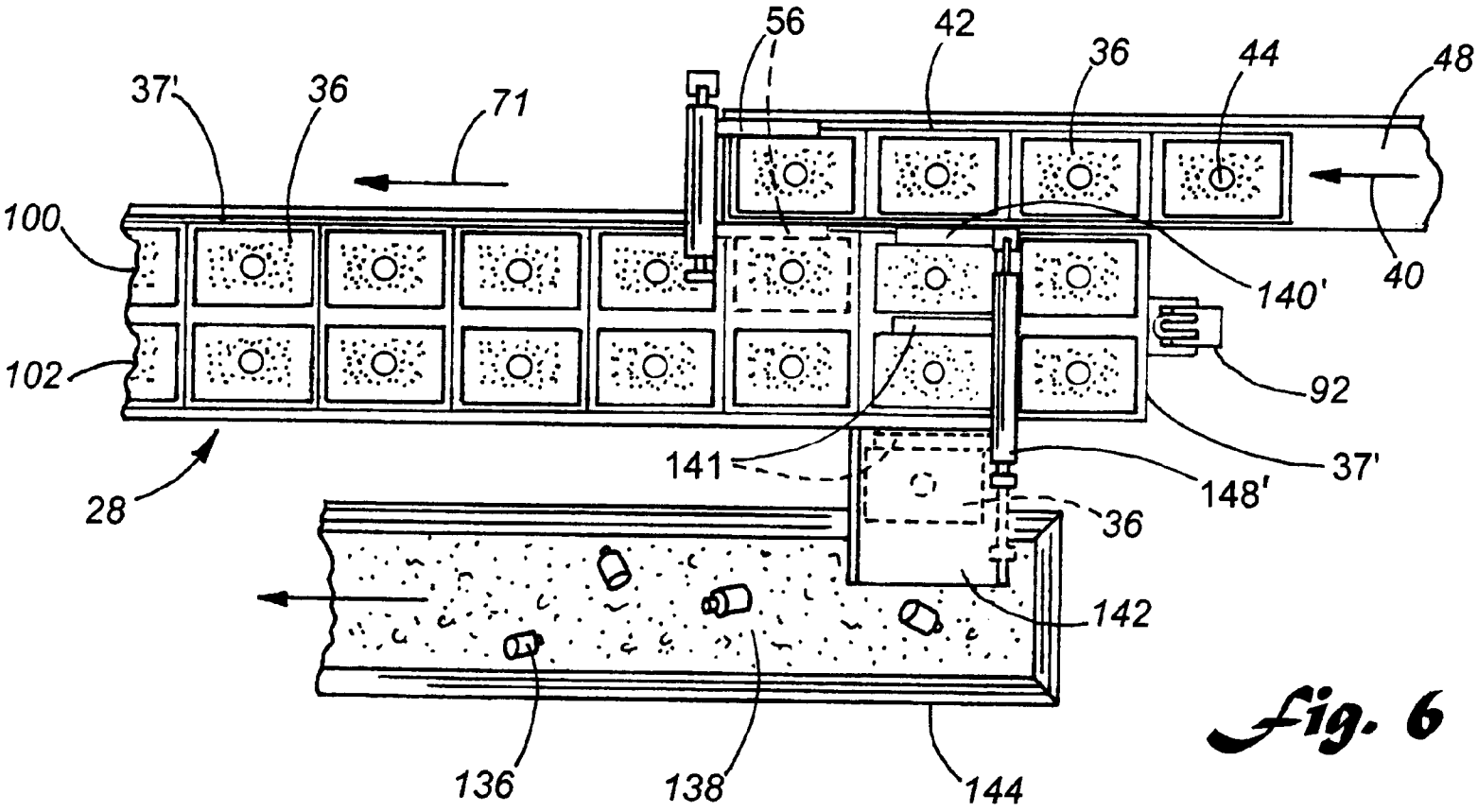
FIG. 6 is a schematic plan view of a second preferred embodiment of the present invention having a mold handling conveyor two rows wide.
Figure 7:
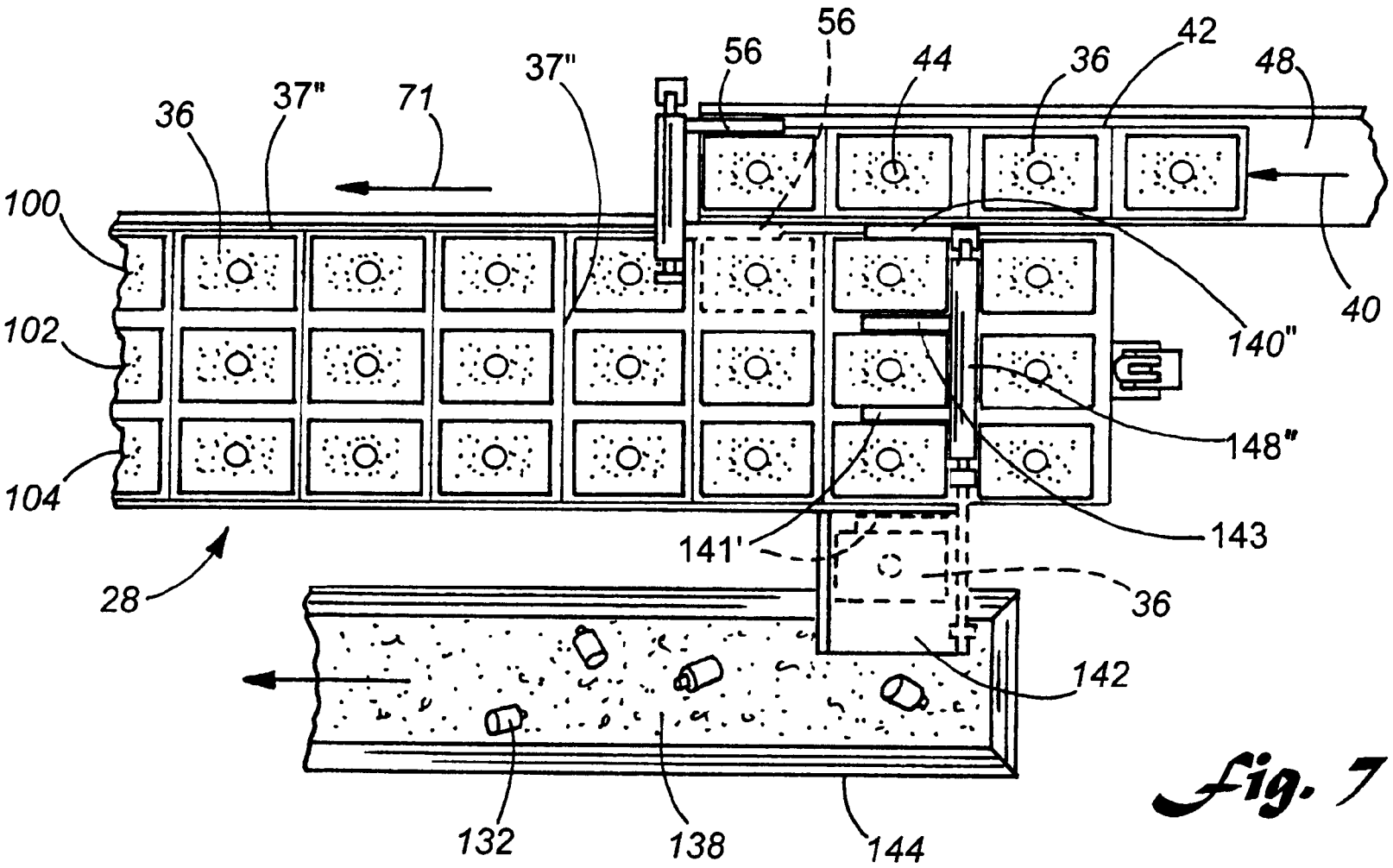
FIG. 7 is a schematic plan view of a third preferred embodiment of the present invention having a mold handling conveyor three rows wide.

As stated earlier, additional cooling time may be required depending on the particular metal being poured. The second and third embodiments of the present invention are therefore provided as best shown in FIGS. 6 and 7, respectively. Operation of the embodiments is substantially the same as the first embodiment, but as can be seen from the figures, the second embodiment provides a wider mold handling conveyor 28, while the third embodiment provides an even wider mold handling conveyor 28. In conjunction therewith, the second embodiment employs a pouring and cooling pallet 37' wide enough to accommodate two molds 36, while the third embodiment using a pouring and cooling pallet 37" wide enough to accommodate three molds 36.

With specific reference to the second embodiment, attention is now drawn to FIG. 6 wherein pouring and cooling pallet 37' and conveyor 28 includes first row 100 and second row 102. Transfer of sand molds 36 from shuttle conveyor 48 to mold handling conveyor 28 is identically the same, as is the installation of weights 76 and jackets 74. Sand molds 36 traverse along conveyor 28 to pouring station 26, move from upper track 86 to lower track 88 in the identical manner, and are moved from lower track 88 to upper track 86 in the identical manner as the first embodiment using elevators 90 and 92, respectively.

However, upon jackets 74 and weights 76 being removed from sand mold 36, the second embodiment departs from the first embodiment, in that rather than being pushed down dump chute 142, sand molds 36 are indexed over to second row 102 via pusher arm 140' to provide additional cooling time. In other words, rather than having sand residue 138 removed from a semi-cooled casting, a second revolution on conveyor 28 is provided through the use of second row 102. To facilitate the pushing action, pallet 37' is lined with graphite in the preferred embodiment, but any surface with a reduced coefficient of friction can be employed. When pusher arm 140' pushes one sand mold 36 to second row 102, a second pusher arm 141, attached to the same hydraulic ram 148', simultaneously pushes another mold 36 from the second row 102 to shake-out conveyor 144. This unique dual-head design minimizes the number of required hydraulic rams, while preventing one mold 36 from being pushed directly against an adjacent mold.

Similarly, if the particular metal or shape being poured requires an even longer cooling time, the third embodiment shown in FIG. 7 can be employed wherein a third row 104 is added to pouring and cooling pallet 37". Upon completing the second revolution on mold handling conveyor 28 along row 102, a third pusher arm 143 can be used to index molds 36 to third row 104. Then, upon completion of the third revolution through row 104, pusher arm 141' can be used to push sand molds 36 down dump chute 142 and to shake-out conveyor 144. A single hydraulic ram 148" is used to power all three pusher arms. It should be noted that with both the second and the third embodiments, while the width of conveyor 28 is varied, a single elevator is used at each end of conveyor 28. Separate pouring and cooling conveyors are not provided as is shown in the parent application. A substantial cost savings is thereby achieved.

In operation, the present invention provides a mold handling system wherein the travel of the individual sand molds 36 is substantially linear to more easily allow for an adjustable throughput volume and a more variable cooling cycle as opposed to carousel systems, wherein potential volume is limited by the diameter of the carousel, and which can only be adjusted by replacing the carousel with another unit of a different diameter. In contrast, the throughput of the present invention can be more easily adjusted simply by adjusting the width of mold handling conveyor 28 and pallet 37.

Another significant advantage of the present invention is the simplified handling of weights 76 and jackets 74, as well as the very limited number of weights and jackets actually needed to operate the entire system. As best shown in FIG. 1, weights 76 and jackets 74 are removed from sand molds 36 before the molds are indexed to another row or dumped for harvest. The weights and jackets therefore are only used at a single row of conveyor 28, which therefore limits the number of weights and jackets required for the whole system. This necessarily reduces the cost of the mold handling system 20.

In addition, since the present invention is numerically controlled via control 64, and is capable of dynamic modification through operator input module 66, the dwell time or cooling time of the metal within each sand mold 36 is also adjustable. The speed with which sand molds 36 are generated from sand mold forming station 22 is adjustable, as is the speed of mold handling conveyor 28. Since each of these functions is centrally controlled as are the movements of pusher arms, the parameters of the entire system 20 can be uniformly increased and decreased.

From the foregoing, it will be appreciated that the present invention brings to the art a new and improved sand mold handling system wherein the volume of molds capable of being processed, and the cooling time of the sand molds are more adjustable. When an increased cooling time is required, a mold handling system of greater width can be employed. Similarly, when it is desired for the cooling time to be decreased, a narrower mold handling conveyor can be used. By controlling the width of the conveyor, the cooling of the castings is more exactly attained, and thus the yield of the overall system is more reliable. Moreover, rather than using separate pouring and cooling conveyors with separate elevators and associated hardware, the present invention is simplified in that a single conveyor is used with a single set of conveyors and associated hardware. A single hydraulic ram with multiple pusher arms or heads is used to further simplify the system and minimize cost, while still enabling cooling dwell time to be adjustable.

What is claimed is:

1. A linear mold handling system for use in a sand mold casting machine having a mechanism for producing a plurality of sand molds, a mechanism for pouring molten material into the sand molds to form castings, and a mechanism for removing the sand from cooled castings, the mold handling system comprising:

a two-tiered linear conveyor of a width sufficient to accommodate a single row of sand molds and having an upper track and a lower track; and a plurality of pouring pallets on the conveyor, each pouring pallet sized to receive a single mold, the pouring pallets and sand molds being conveyed on the upper track from the mechanism for producing sand molds to the pouring mechanism, the conveyor having a first elevator to move the pallets and molds from the upper track to the lower track, and a second elevator for moving the pallets and molds from the lower track to the upper track.

2. The linear mold handling system of claim 1 wherein the first and second elevators include hydraulic rams adapted to impart motion to move the sand molds incrementally along the conveyor upper and lower tracks.

3. The linear mold handling system of claim 1 wherein the mechanism for removing sand from cooled castings includes a first hydraulically actuated pusher arm, an inclined dump chute, and a vibrating conveyor, the pusher arm adapted to push cooled sand molds from the upper track, down the dump chute and on to the vibrating conveyor.

4. The linear mold handling system of claim 3 further including a second hydraulically actuated pusher arm adapted to move sand molds from the mechanism for producing sand molds to the pouring pallets provided on conveyor upper track.

5. A linear mold handling system for use in a sand mold casting machine having a mechanism for producing a plurality of sand molds, a mechanism for pouring molten material into the sand molds to form castings, and a mechanism for removing the sand from cooled castings, the mold handling system comprising:

a two-tiered conveyor of a width sufficient to accommodate first and second rows of sand molds and having an upper track and a lower track; and a plurality of pouring and cooling pallets on the conveyor, each pouring and cooling pallet sized to receive first and second molds, the pallets and sand molds being conveyed on the upper track first row from the mechanism for producing sand molds to the pouring mechanism, the conveyor having a first elevator to move the pallets and sand molds from the upper track to the lower track, and a second elevator for moving the sand molds and pallets from the lower track to the upper track.

6. The linear mold handling system of claim 5 wherein the first and second elevators include hydraulic rams adapted to impart motion to move the sand molds and pallets incrementally along the conveyor upper and lower tracks.

7. The linear mold handling system of claim 5 wherein the mechanism for removing sand from cooled castings includes a first hydraulically actuated pusher arm, an inclined dump chute, and a vibrating conveyor, the pusher arm adapted to push cooled sand molds from the upper track second row down the dump chute and onto the vibrating conveyor.

8. The linear mold handling system of claim 7, further including a second hydraulically actuated pusher arm adapted to push cooled sand molds from the first row to the second row, the first and second pusher arms being powered by a single hydraulic cylinder.

9. The linear mold handling system of claim 7 further including a third hydraulically actuated pusher arm adapted to move sand molds from the mechanism for producing sand molds to the conveyor upper track first row.

10. The linear mold handling system of claim 7 wherein the pouring and cooling pallets are coated with graphite to facilitate sliding.

11. A linear mold handling system for use in a sand mold casting machine having a mechanism for producing a plurality of sand molds, a mechanism for pouring molten material into the sand molds to form castings, and a mechanism for removing the sand from cooled castings, the mold handling system comprising:

a two-tiered conveyor of a width sufficient to accommodate first, second, and third rows of sand molds and having an upper track and a lower track; and a plurality of pouring and cooling pallets on the conveyor, each pallet sized to receive first, second, and third sand molds, the sand molds and pallets being conveyed on the upper track first row from the mechanism for producing sand molds to the pouring mechanism, the conveyor having a first elevator to move the sand molds and pallets from the upper track to the lower track, and a second elevator for moving the sand molds and pallets from the lower track to the upper track.

12. The linear mold handling system of claim 11 wherein the first and second elevators include hydraulic rams adapted to impart motion to move the sand molds and pallets incrementally along the conveyor upper and lower tracks.

13. The linear mold handling system of claim 11 wherein the mechanism for removing sand from cooled castings includes a first hydraulically actuated pusher arm, an inclined dump chute, and a vibrating conveyor, the pusher arm adapted to push cooled sand molds from the upper track third row down the dump chute and on to the vibrating conveyor.

14. The linear mold handling system of claim 13 further including second and third hydraulically actuated pusher arms, the second pusher arm adapted to slide sand molds on the pallets from the second row to the third row, the third pusher arm adapted to slide molds on the pallets from the first row to the second row, the first, second, and third pusher arms being powered by a single hydraulic cylinder.

15. The linear mold handling system of claim 14 further including a second hydraulically actuated pusher arm adapted to move sand molds from the mechanism for producings and molds to the conveyor upper track first row.

16. The linear mold handling system of claim 15 wherein the pouring and cooling pallets are coated with graphite to facilitate sliding.

* * * * *

UNITED STATES PATENT AND TRADEMARK OFFICE

CERTIFICATE OF CORRECTION

PATENT NO. : 6,145,577

DATED : November 14, 2000

INVENTOR(S) : William A. Hunter and William G. Hunter

It is certified that error appears in the above-identified patent and that said Letters Patent is hereby corrected as shown below:

In claim 15, line 58, change "producings and" to "producing sand".

Signed and Sealed this

Eighth Day of May, 2001

*Attest:*

Nicholas P. Godici

NICHOLAS P. GODICI

*Attesting Officer*

*Acting Director of the United States Patent and Trademark Office*